US012692693B2

(12) United States Patent
Freestone

(10) Patent No.: US 12,692,693 B2
(45) Date of Patent: Jul. 28, 2026

(54) SYSTEMS AND METHODS FOR PROVIDING A TRUSS STRUCTURE

(71) Applicant: Eagle Technology, LLC, Melbourne, FL (US)

(72) Inventor: Michael Freestone, Moss Beach, CA (US)

(73) Assignee: Eagle Technology, LLC, Melbourne, FL (US)

( * ) Notice: Subject to any disclaimer, the term of this patent is extended or adjusted under 35 U.S.C. 154(b) by 20 days.

(21) Appl. No.: 18/956,806

(22) Filed: Nov. 22, 2024

(65) Prior Publication Data

US 2026/0146435 A1 May 28, 2026

(51) Int. Cl.
*E04B 1/19* (2006.01)

(52) U.S. Cl.
CPC .... *E04B 1/1906* (2013.01); *E04B 2001/1927* (2013.01); *E04B 2001/1942* (2013.01); *E04B 2001/1957* (2013.01)

(58) Field of Classification Search
CPC ..... E04B 2001/1927; E04B 1/1906; E04B 2001/196; E04B 1/1903; Y10T 403/342; B64G 99/00; B64G 1/641; B64G 1/6457
See application file for complete search history.

(56) References Cited

U.S. PATENT DOCUMENTS 4,334,816 A 6/1982 Slysh
4,438,615 A * 3/1984 Wendel ..... F16B 7/18 403/171
4,763,459 A 8/1988 Wesselski
4,863,303 A 9/1989 Croucher, Jr. et al.
RE33,438 E * 11/1990 Stewart ..... F16B 7/22 24/654
5,632,129 A * 5/1997 Imai ..... E04B 1/3211 403/171
5,885,312 A * 3/1999 Fruitman ..... B24B 37/245 51/296
5,956,917 A * 9/1999 Reynolds ..... E04B 1/585 52/81.3
8,820,025 B1 * 9/2014 Rochas ..... E04B 1/1906 52/81.3
9,562,352 B2 * 2/2017 Benthien ..... E04B 1/19
(Continued)

FOREIGN PATENT DOCUMENTS

WO 2016138426 9/2016

*Primary Examiner* — Brian E Glessner
*Assistant Examiner* — Daniel J Kenny
(74) *Attorney, Agent, or Firm* — Fox Rothschild LLP; Carol E. Thorstad-Forsyth

(57) ABSTRACT

Systems and methods for providing a truss structure. The methods comprise: increasing a distance between a first end fitting coupled to a first node and a second end fitting coupled to a second node by actuating a flexure member to cause cup member of first end fitting to move in a first direction toward the first node; inserting a tube between the first and second end fittings; receiving a first end of the tube in an insert space of the second end fitting; decreasing the distance between the first end fitting and the second end fitting by actuating the flexure member to cause at least the cup member of the first end fitting to move in an opposing second direction away from the first node; and receiving a second end of the tube in an insert space of the first end fitting to provide a portion of the truss structure.

13 Claims, 17 Drawing Sheets

(56) References Cited

U.S. PATENT DOCUMENTS

| | | | | |
|---|---|---|---|---|
| 9,970,190 | B2 * | 5/2018 | Benthien | B64C 3/48 |
| 10,112,731 | B2 | 10/2018 | Rodrigues et al. | |
| 11,359,364 | B1 | 6/2022 | Eller et al. | |
| 11,870,183 | B2 * | 1/2024 | Shasho | H01R 13/62927 |
| 2002/0150444 | A1 * | 10/2002 | Mhaimeed | F16B 7/185<br>411/383 |
| 2010/0139192 | A1 * | 6/2010 | Ng | E04B 1/32<br>52/646 |
| 2017/0130766 | A1 * | 5/2017 | Benthien | E04C 3/08 |

* cited by examiner

SYSTEMS AND METHODS FOR PROVIDING A TRUSS STRUCTURE

BACKGROUND

There are many truss structures that are used with vehicles to support equipment. The vehicles can include, for example, spacecraft and/or satellites. The equipment can include, for example, payloads and/or altitude controls. Each truss structure comprises struts coupled to each other via nodes.

SUMMARY

This document concerns implementing systems and methods for providing a truss structure to structurally support equipment. The methods comprise: increasing a distance between a first end fitting coupled to a first node and a second end fitting coupled to a second node by actuating a flexure member to cause at least a cup member of the first end fitting to move in a first direction toward the first node; inserting a tube between the first and second end fittings; receiving a first end of the tube in an insert space of the second end fitting; decreasing the distance between the first end fitting and the second end fitting by actuating the flexure member to cause at least the cup member of the first end fitting to move in an opposing second direction away from the first node; and receiving a second end of the tube in an insert space of the first end fitting to provide a portion of the truss structure.

This document also concerns a truss structure. The truss structure comprises: first and second nodes; a tube extending between the first and second nodes; a first end fitting coupling the first node to a first end of the tube; and a second end fitting coupling the second node to an opposing second end of the tube. The first end fitting comprises a cup member and a flexure member. The flexure member is configured to be actuated to cause the cup member to move relative to the first node for changing a distance between a first end fitting and the second end fitting.

BRIEF DESCRIPTION OF THE DRAWINGS

This disclosure is facilitated by reference to the following drawing figures, in which like numerals represent like items throughout the figures.

DETAILED DESCRIPTION

As noted above, there are many truss structures that are used with base support structure (e.g., vehicles or fixed support structures) to physically support equipment and/or facilitate coupling of the equipment to communication buses or circuits. The vehicles can include, for example, spacecraft and/or satellites. The equipment can include, for example, payloads and/or altitude controls. In many applications such as space applications, the overall design of the truss structure should be optimized to provide a rigid and lightweight structure with a low or near-zero coefficient of thermal expansion (CTE). A low or near-zero CTE provides a solution with no or a relatively small amount of expansion and/or contraction responsive to temperature changes. Conventional techniques for such design optimization are costly, time-consuming and labor-intensive. Also, conventional truss structures are often primarily aluminum structures or graphite structures. Aluminum and graphite are relatively expensive materials. Conventional truss structures also suffer from line-of-sight thermal distortion errors due to their brackets.

The present solution solves these drawbacks of conventional truss structures. The present solution also provides a solution for designing, analyzing and building complex 2D and/or 3D truss structures which have relatively high-performance, low-cost and/or low mass. However, the present solution will be discussed below in relation to a relatively simple truss structure. The present solution is not limited in this regard.

It should be noted that the present solution allows for efficient custom builds of truss structures (e.g., by leveraging additive manufacturing) and/or composite materials (e.g., carbon composites) to satisfy structural requirements of given applications. The custom build feature of the present solution is facilitated by the that fact that the angles between adjacent struts are not limited to certain defined angles (e.g., 30°, 45°, 60° and/or 90° angles). In effect, the truss structures are not forced into certain geometries due to the limited possible angles between adjacent struts. The nodes of the present solution are configured to allow any number of struts to be coupled thereto and allow for nearly any angle between adjacent struts.

The present solution may leverage 3D printed, molded or machined nodes to allow for full customization of the truss structure using novel features built into the nodes. These novel features include, but are not limited to, adjustable or telescoping node end fittings to facilitate assembly of a truss, in particular within the constraints of tooling, node end fittings configured to facilitate CTE tuning to near-zero for relatively high thermal stability, a novel sealing means using porous polymer(s) to yield a more robust injection bonding process by eliminating trapped air, and a double-shear bond that is relatively stronger than a single-shear bond (e.g., 1.5-2× stronger).

Figure 1:
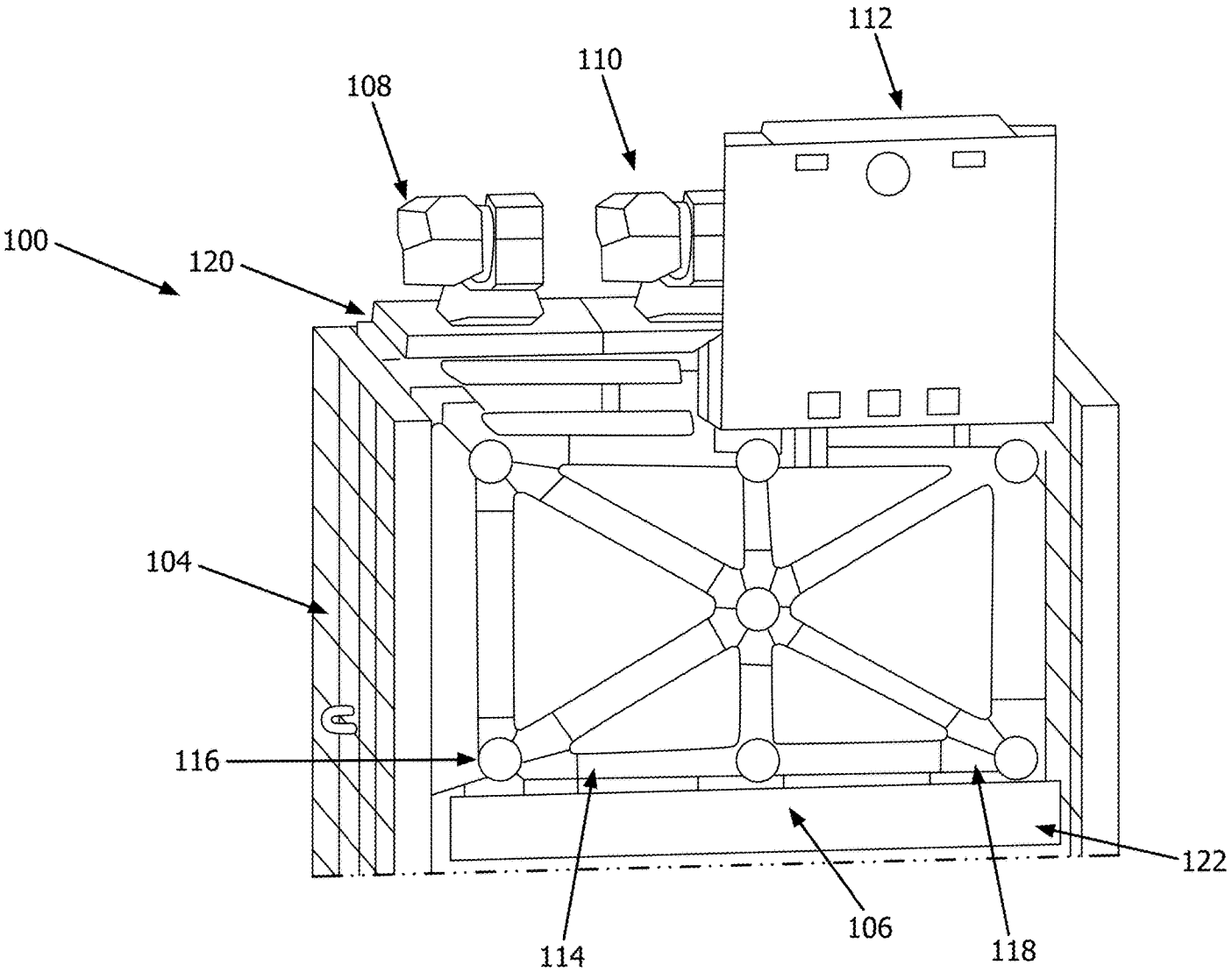
FIG. 1 provides an illustration of a system implementing the present solution.

FIG. 1 provides an illustration of a system 100 comprising a housing 102 in which a truss structure 104 is disposed. System 100 can include, but is not limited to, a vehicle. The vehicle can include, for example, spacecraft and/or satellites. Truss structure 104 implements the present solution and is designed to structurally support equipment 108, 110, 112. The equipment can include, but is not limited to, sensors (e.g., cameras), payloads, and/or attitude controls. In this regard, the truss structure 104 is coupled between equipment interfaces 120 and a vehicle interface 122. These interfaces 120, 122 may, for example, facilitate electrical connection between electronic devices and a communications bus.

Truss structure 104 includes a plurality of struts 114 coupled to each other via nodes 116. Truss structure 104 is designed to have a relatively high performance, low cost, and low mass. In this regard, the struts 114 may be formed of, for example, Invar, graphite, carbon composite(s), titanium, and/or steel. Each strut 114 is coupled to a node 116 via an end fitting 118. Nodes 116 and/or end fittings 118 may be formed of the same or different material as the struts 114. The struts 114, nodes 116 and/or end fittings 118 may be 3D printed, injection molded, and/or machined. In some scenarios, a node 116 and/or an end fitting 118 are separate components. In other scenarios, a node 116 and/or respective end fitting(s) 118 are integrally formed as a single piece.

The novel way in which the struts 114 are attached to the nodes 116 will become evident as the discussion progresses. Still, it should be noted here that the nodes 116 may comprise adjustable end fittings 118. The adjustable end fittings 118 may facilitate (i) assembly of the truss structure, and (ii) CTE tuning to near-zero for relatively high thermal stability. With regard to feature (i), the end fittings 118 include adjustable features for changing a distance between the end fitting and a node 116. The adjustable features can include, but are limited to, threaded elements, telescoping elements, other elongating/shorting structures, and/or other expandable/collapsable structures.

The adjustable end fittings 118 may employ a novel sealing means for creating and maintaining a seal between the end fitting and each strut, while accounting for part size tolerances and/or allowing movement and/or angular misalignment of the strut relative to the end fitting within a range of degrees (e.g., 0°-1°, 0°-2°, 0°-3°, 0°-4°, 0°-5°, . . . , 0°-N°, 1°-5°, 2°-5°, 3°-5°, 4°-5°, 0°-N°, etc., where N is any integer greater than zero). The sealing means can include, but is not limited to, a porous polymer material and/or a porous foam. For example, the sealing means comprises a porous expanded Polytetrafluoroethylene (PTFE) or a porous Teflon to yield a relatively robust injection bonding process by eliminating trapped air (to ensure voids are not created within the bonding area). Porous PTFE comprises an expanded cell network with cells to allow air to escape but not a fluid or liquid. The injection bonding process and air removal will be discussed in more detail below. Still, it should be noted here that a double-shear bond is provided using a robust sealing means configured to allow trapped air to escape but not the bonding fluid during the injection bonding process. The present solution is not limited in this regard.

With regard to above-mentioned feature (ii), a near-zero CTE may be tuned by selecting different materials for each of two or more of struts 114, nodes 116, and end fittings 118. For example, end fitting 118 may be made of aluminum, while node 116 is formed of stainless steel and strut 114 is formed of titanium. The present solution is not limited to the particulars of this example.

Figure 2:
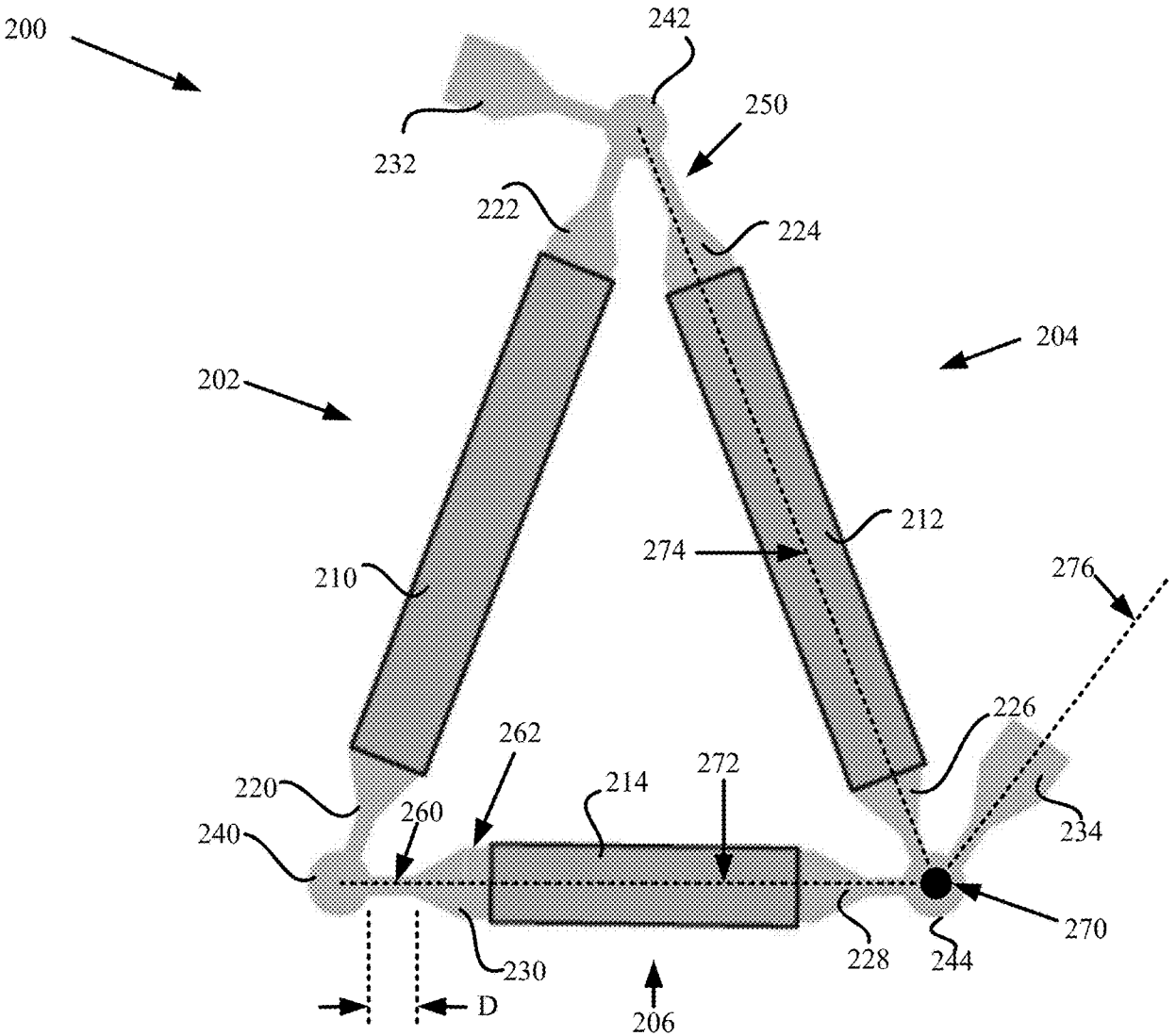
FIG. 2 provides an illustration of a truss structure.

FIG. 2 provides an illustration of a truss structure 200 implementing the present solution. Truss structure 200 may be included in truss structure 100 of FIG. 1 and/or facilitate further understanding of truss structure 100 since truss structure 100 may be the same as or similar to truss structure 200.

Truss structure 200 comprises three branches 202, 204, 206. Each branch comprises a tube 210, 212, 214, end fittings 220, 222, 224, 226, 228, 230, 232, 234, and nodes 240, 242, 244. Tubes 210, 212, 214 may also be referred to as struts. Tubes 210-214, end fittings 220-234 and/or nodes 240-244 may be formed of the same material or different materials. Tubes 210-214, end fittings 220-234 and/or nodes 240-244 may be formed of, for example, Invar, Kovar, graphite, carbon composite(s), titanium, and/or steel. If all tubes 210-214 are made of a single graphite tube option and all nodes 240-244 are made from the same material, then the lower tube 214 would have a higher CTE. If the flexure sections 250 of the end fittings 220-234 are made from a threaded rod of various materials, then the lower tube 214 could use an Invar stud to balance out the CTE with the upper two tubes 210 and 212. Other configurations are contemplated for tuning the CTE of the branches 202-206. A net-zero CTE may be desired for thermal stability of the truss structure 200. Adding more materials enables an optimization to near-zero CTE for any length of tube. Having only two materials (e.g., titanium and graphite) may result in a net strut CTE of 4.4 ppm/C at ten inches. Having four or more materials (e.g., Invar, titanium and stainless steel) may provide a balance of material CTEs to result in a near-zero CTE for a branch.

Tubes 210-214, end fittings 220-234 and/or nodes 240-244 may be 3D printed, injection molded, and/or machined. Nodes provide a common vertex for all strut lines of action to eliminate eccentricities. For example, node 244 provides a common vertex 270 for strut lines 272, 274, 276.

In FIG. 2, nodes and end fittings are integrally formed. For example, end fittings 220, 230 are integrally formed with node 240 to provide a single piece. End fittings 222, 224, 232 are integrally formed with node 242 to provide a single piece. End fittings 226, 228, 234 are integrally formed with node 244 to provide a single piece. The present solution is not limited in this regard. The nodes and end fittings may be formed as separate components in other scenarios.

Each end fitting comprises a proximal end 260 coupled to a node and a distal end 262 coupled to a tube. Each tube 210, 212, 214 is coupled between two nodes via respective opposing end fittings. For example, tube 210 is connected between nodes 240, 242 via opposing end fittings 220, 222. Tube 212 is connected between nodes 242, 244 via opposing end fittings 224, 226. Tube 214 is connected between nodes 240, 244 via opposing end fittings 228, 230. Other tubes may be connected between end fittings 232, 234 and other opposing end fittings not shown in FIG. 2.

Proximal end 260 of at least one of the two end fittings for each tube is configured to allow a distance D to be adjusted to facilitate installation of a tube in truss structure 200. For example, end fitting 230 has a proximal end 260 coupled to node 240 and a distal end 262 coupled to tube 214. Proximal end 260 comprises adjustable feature(s) to facilitate adjustment of distance D. The adjustable feature(s) can include, but are limited to, threaded elements, telescoping elements, other elongating/shorting structures, and/or other expandable/collapsable structures. The telescoping features should be locked in position (or rigidized after telescoping) prior to completion of the truss structure. The adjustable feature(s) may comprise a rod flexure section to limit bending moments for improved strength margins. Distal end 262 comprises: a bondline gap (not visible in FIG. 2) around or on either side of the tube to allow for part and/or assembly tolerances of N degrees per strut (e.g., approx. 2°); and a sealing member (not visible in FIG. 2) configured to dam a bonding agent (not visible in FIG. 2) within an internal channel (not visible in FIG. 2) of the end fitting while allowing trapped air to pass therethrough. A double-shear bond may provide high strength allowing for smaller diameter tubes.

FIG. 3 provides illustrations showing how a truss structure 300 may be built in a space between interfaces 390, 392, 394 of a 3D assembly. Truss structure 300 may be included in truss structure 100 of FIG. 1 and/or facilitate further understanding of truss structure 100 since truss structure 100 may be the same as or similar to truss structure 300. Adding a third strut or tube to form a triangular structure is relatively difficult when the triangle is being constrained by the 3D assembly, as would typically occur when rigid tooling is used to locate critical interfaces attached to the nodes. The present solution addresses this difficulty by making it relatively easy to install the third strut or tube. The manner in which the third strut or tube is installed in the truss structure 300 will now be discussed in detail.

Figure 3A:
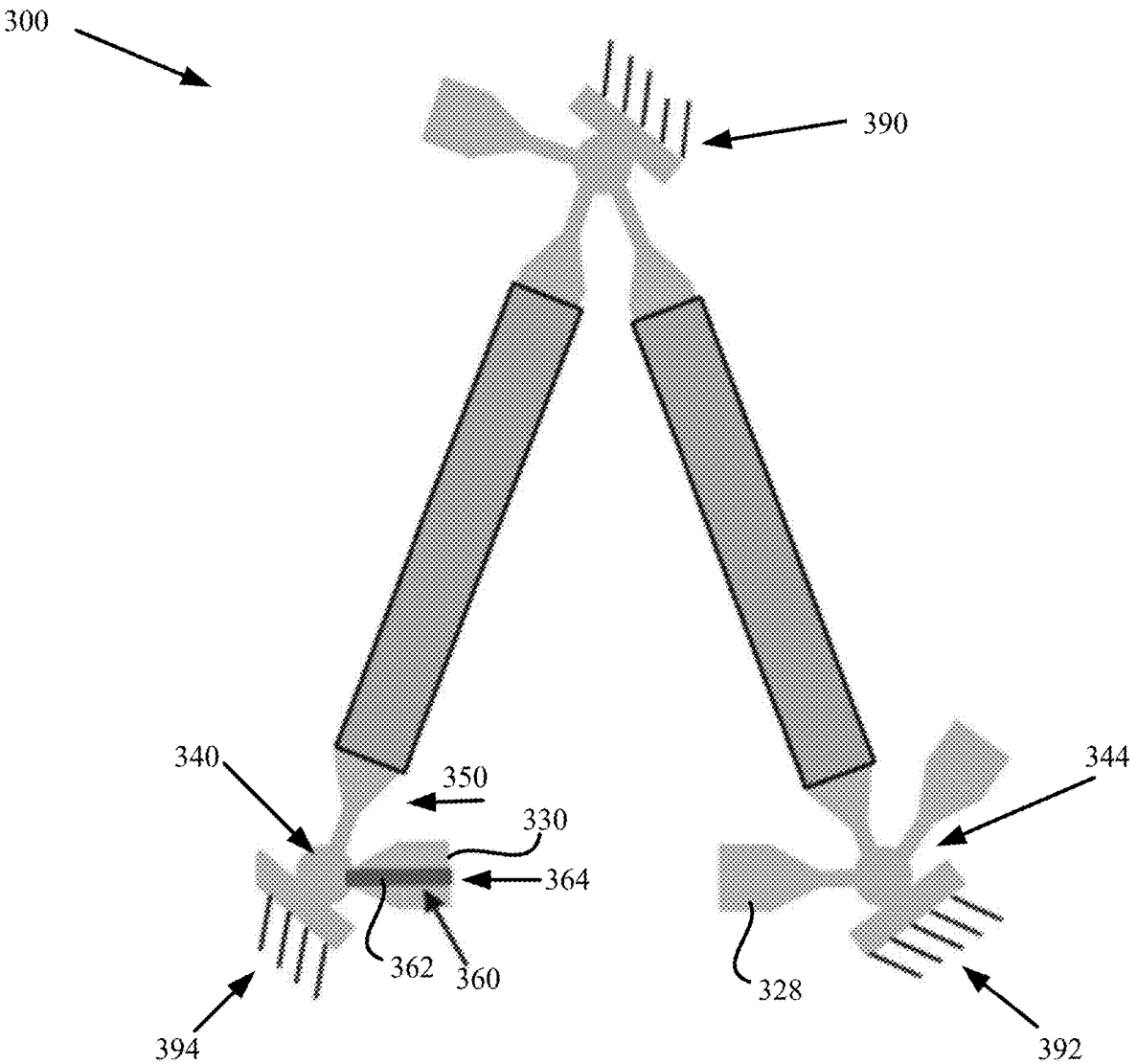
FIGS. 3A-3C (collectively referred to as "FIG. 3") provide illustrations that are useful for understanding how the truss structure of FIG. 2 may be built.

Starting with FIG. 3A, an end fitting 330 is manipulated or actuated to cause it to retract or otherwise move (e.g., slide, rotate, collapse, etc.) in direction 350 toward node 340. This adjustment of the end fitting's position relative to node 340 may be (i) facilitated by adjustable feature 360 and (ii) performed until end fitting 330 contacts or comes in proximity to node 340. Adjustable feature 360 can include, but is not limited to, a threaded post 362 configured to threadingly engage threads formed in an aperture 364 of the end fitting 330.

Figure 3B:
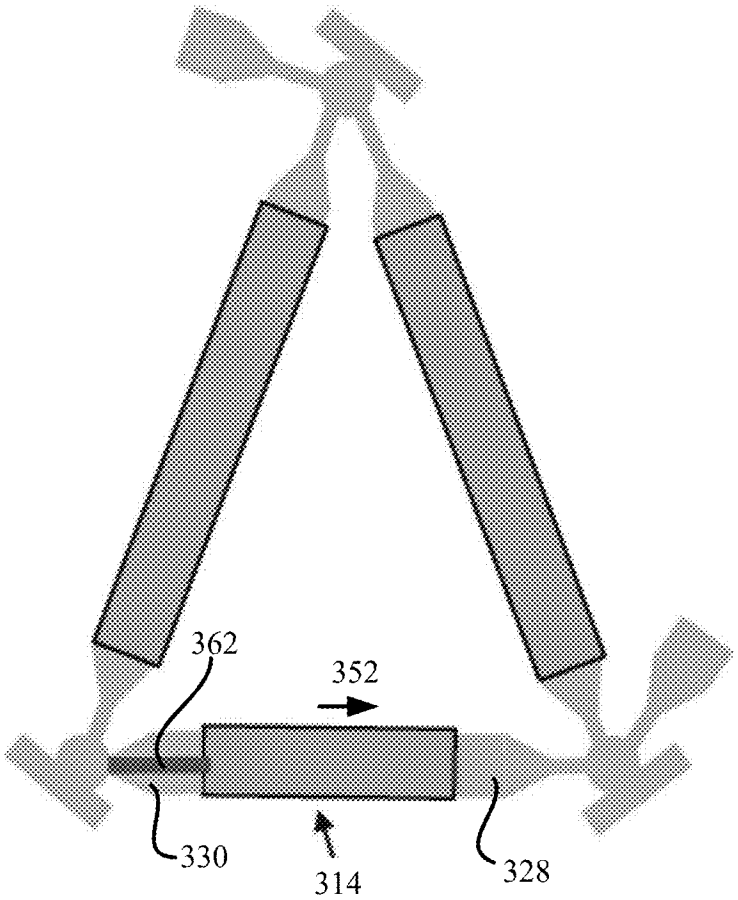
Figure 3C:
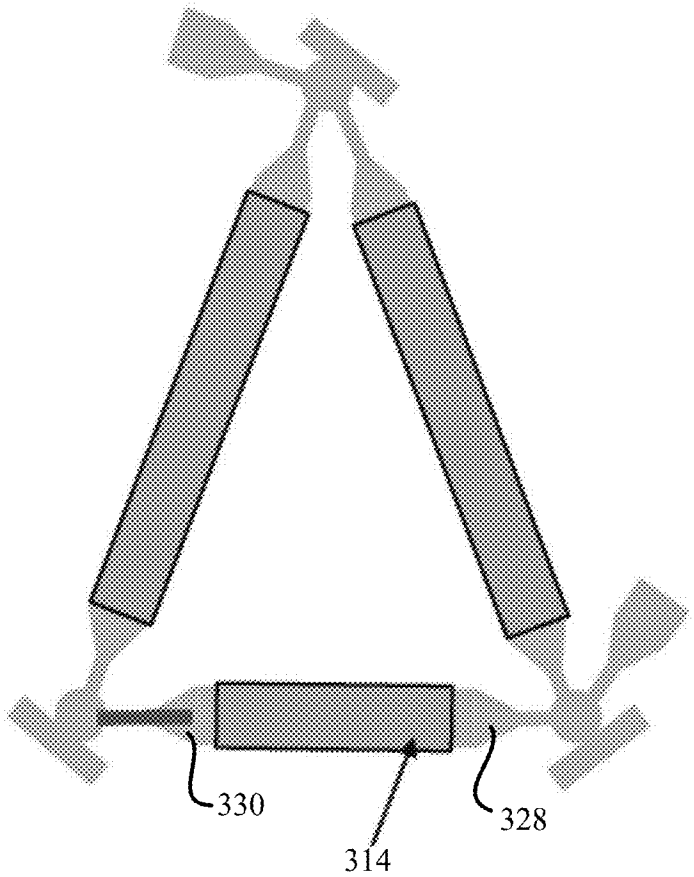

Next as shown in FIG. 3B, strut or tube 314 is inserted between end fitting 330 and opposing end fitting 328. The strut or tube 314 is then slid in direction 352 towards end fitting 328 and away from end fitting 330. End fitting 330 is then manipulated or actuated to cause it to move in direction 352. For example, end fitting 330 is caused to rotate around threaded post 362 until strut or tube 314 is securely retained between end fittings 328, 330, as shown in FIG. 3C. The strut or tube 314 is injection bonded to end fittings 328, 330.

It should be noted that the present solution is not limited to the truss structure architecture shown in FIG. 3. For example, at least one adjustable end fitting may be used at one or both ends of each of the three struts or tubes for coupling it to node(s).

FIG. 4 provides cross-sectional views that are useful for understanding features of a double-shear injection bonded end fitting 400. End fittings 118 of FIG. 1, 220-234 of FIG. 2, and/or 328-330 of FIG. 3 may be the same as or similar to end fitting 400. Thus, the discussion of end fitting 400 is sufficient for further understanding end fittings 118, 220-234, 328-330.

End fitting 400 comprises a cup member 402 and a flexure member 404. Cup member 402 comprises tapered adherends or surfaces 470, 472 to reduce shear peaking and bondline stresses at its end 474. Flexure member 404 can include, but is not limited to, a threaded rod as shown or other structure (e.g., a telescoping structure). Flexure member 404 may be formed of the same or different material as the cup member 402. Members 402, 404 may be formed of, for example, Invar, graphite, carbon composite(s), titanium, and/or steel.

Cup member 402 comprises a base structure 406 having a generally U-shaped cross-section profile. A sidewall 408 of the base structure 406 extends around a hollow area 410. Hollow area 410 is sized and shaped to allow the flexure member 404 to move into and out of the base structure 406 without being obstructed.

Figure 4A:
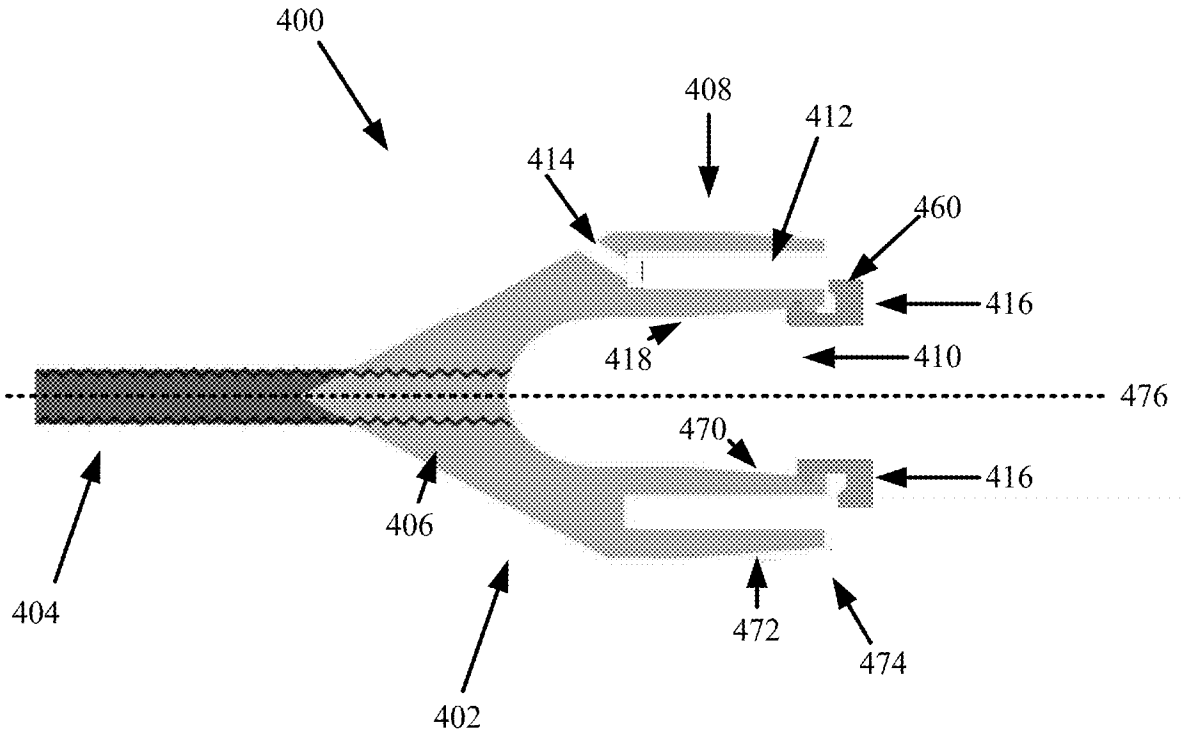
FIGS. 4A-4D (collectively referred to as "FIG. 4") provide illustrations that are useful for understanding how a novel seal is provided with the truss structure.
Figure 4B:
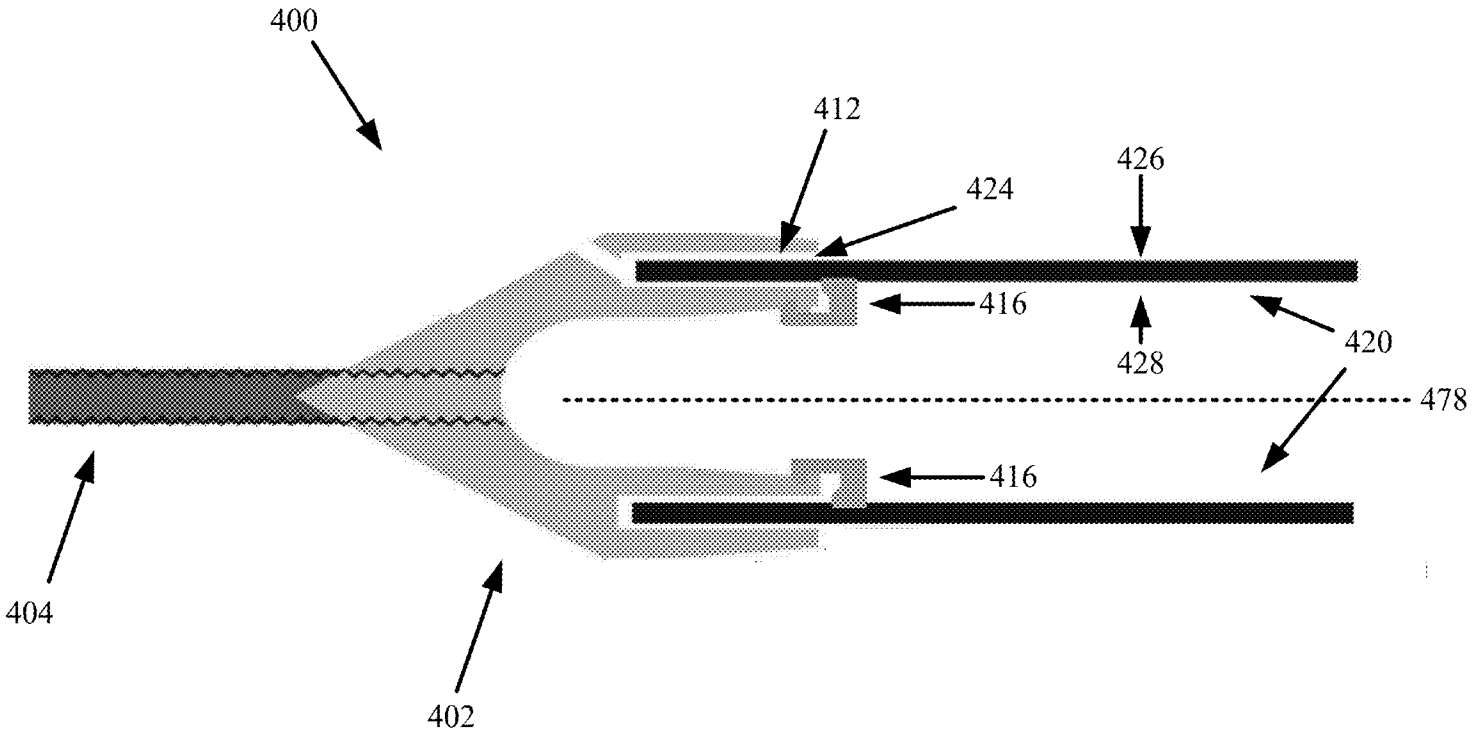
Figure 4C:
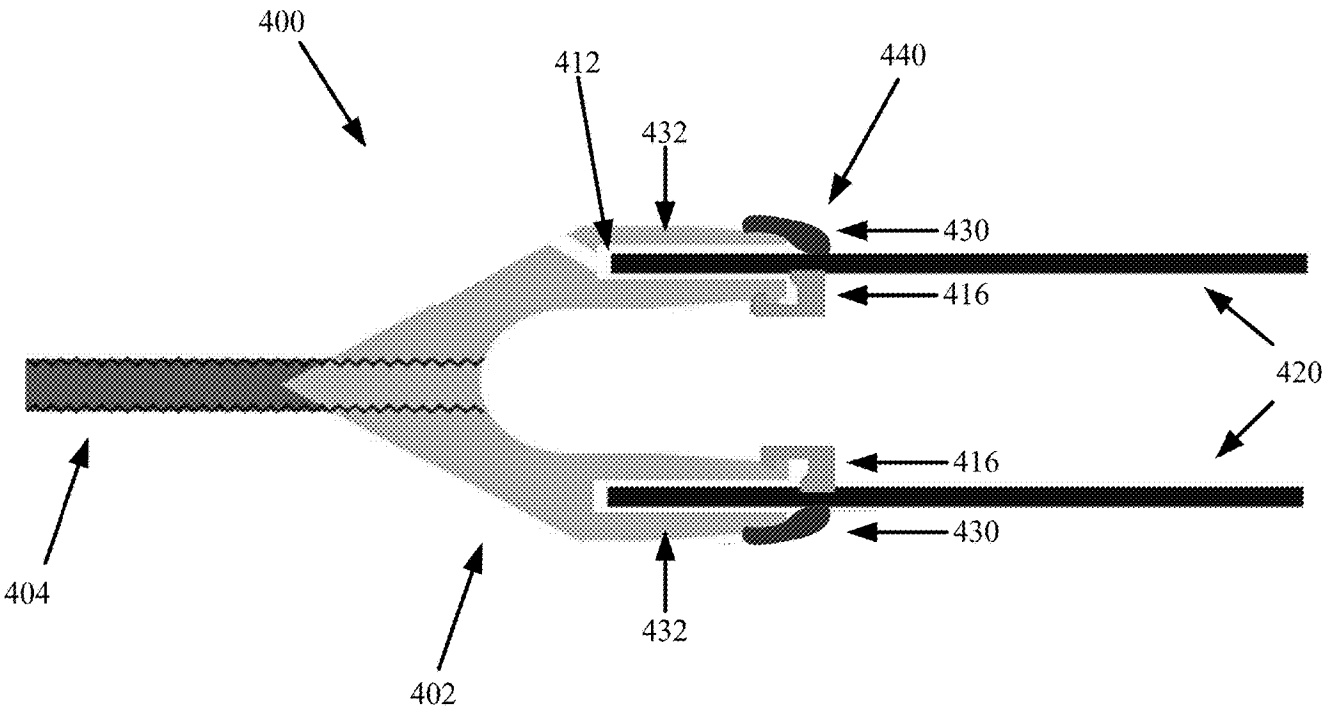

Sidewall 408 has an annular insert space or cavity 412 for receiving a strut or tube 420 as shown in FIG. 4B. A sealing member 416 is coupled to an inside wall 418 of the base structure 406 defining the insert space 412. Any known or to be known coupling technique can be used here (e.g., a snap-fit, interlocking structure, adhesive, etc.). It should be noted that sufficient pre-load through interference should be achieved to ensure sealing at the coupling interface to resist injection bonding pressures in, for example, the 5-30 psig range. For example, sealing member 416 may be configured to create interference with a node, barb or other projection 460 and strut/tube 420. The present solution is not limited in this regard. Sealing member 416 may also comprise a metal to create a dissipative ground path between the strut/tube 420 and the base structure 406.

Sealing member 416 extends around the entire circumference of wall 418. Sealing member 416 is configured to: (i) hold strut or tube 420 in place while the truss structure is being built due to a frictional engagement between the sealing member 416 and strut/tube 420; and (ii) allow movement of the strut/tube 420 relative to the end fitting 400 while maintaining the seal therebetween prior to and after the truss structure 400 is built. With regard to purpose or function (i), sealing member 416 may be configured to apply a radial force on the strut/tube 420 in an outward direction. With regard to purpose or function (ii), the sealing member 416 is configured to compress or otherwise deform when the strut/tube applies a force thereon and return to its original uncompresses or non-deformed state when the force is no longer being applied thereto by the strut/or tube 420. The strut or tube 420 can slide against and/or apply forces on the sealing member 416 without damaging the same. Sealing member 416 can include, but is not limited to, a porous polymer material and/or a porous foam. For example, the sealing member 416 comprises a porous expanded PTFE, a porous Teflon, and/or a porous Fluoroplastic foam.

Figure 4D:
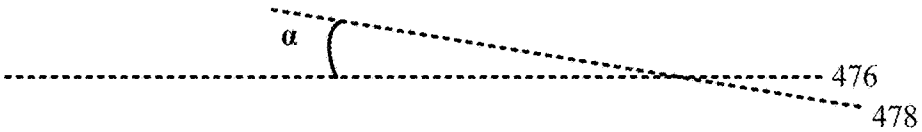

It should be noted that insert space 412 is sized so that a bondline gap 424 is provided on one or both sides 426, 428 of the strut or tube 420. The bondline gap is sized to allow for tolerance take-up (e.g., liquid shim). For example, a 25 mil bondline gap (0.025 inches) is provided on either side of the strut or tube. The present solution is not limited to the particulars of this example. The bondline gap 424 allows movement and/or angular misalignment of the strut/tube 420 relative to the end fitting 400 within a range of degrees (e.g., 0°-1°, 0°-2°, 0°-3°, 0°-4°, 0°-5°, . . . , 0°-N°, 1°-5°, 2°-5°, 3°-5°, 4°-5°, 0°-N°, etc., where N is any integer greater than zero). When an angular alignment exists, a center axis 476 (see FIG. 4A) of the end fitting 400 and a center axis 478 (see FIG. 4B) of the strut/tub extend parallel and overlap each other. In contrast, when an angular misalignment exists, the center axis 476 (see FIG. 4A) of the end fitting 400 and the center axis 478 (see FIG. 4B) of the strut/tub do not extend parallel to each other, but instead are angled relative to each other as shown in FIG. 4D. The angle $\alpha$ between the center axis 476, 478 falls within the range of degrees of angular misalignment allowed by the bondline gap 424.

Another sealing member 430 (shown in FIG. 4C) is installed after the strut or tube 420 has been received in insert space 412. Sealing member 430 is coupled to an outside wall 432 of the base structure 406 defining the insert space 412. Sealing member 430 may also be coupled the strut or tube 420. Any known or to be known coupling technique can be used here. Sealing member 430 may be formed of the same or different material as sealing member 416. In some scenarios, sealing member 430 may be in the form of a tape or foam. Sealing member 430 extends around the entire circumference of wall 432. Sealing member 430 is configured to: (i) hold strut or tube 420 in place while the truss structure is being built due to a frictional engagement between the sealing member 430 and strut/tube 420; and (ii) allow movement of the strut/tube 420 relative to the end fitting 400 while maintaining the seal therebetween prior to and after the truss structure 400 is built. With regard to purpose or function (i), sealing member 430 may apply a radial force on the strut/tube 420 in an inward direction. With regard to purpose or function (ii), the sealing member 430 is configured to compress or otherwise deform when the strut/tube applies a force thereon and return to its original uncompresses or non-deformed state when the force is no longer being applied thereto by the strut/or tube 420. The strut or tube 420 can slide against and/or apply forces on the sealing member 430 without damaging the same.

One or more injection holes 414 are provided around the perimeter of the base structure 406 to allow a bonding agent to be injected into space 412 for bonding the strut or tube 420 to the end fitting 400. An injection hole may be provided every M degrees, where M is an integer between 0 and 180. The bonding agent acts like a liquid shim. The bonding agent can include, but is not limited to, an epoxy paste or other adhesive. For example, the bonding agent may be a high-wetting low-viscosity epoxy referred to as Hysol 9396®. The present solution is not limited to the particulars of this example.

During the bonding injection process, sealing members 416, 430 (i) hold strut or tube 420 in place while the bonding injection process is being performed due to a frictional engagement between the sealing members and strut/tube, (ii) provide a bonding agent dam, and (iii) provide an air vent. With regard to purposes or functions (ii) and (iii), sealing members 416, 430 are configured to prevent the bonding agent from traveling out of the insert space 412 at distal end 440, while allowing air to vent out of insert space 412. Sealing member 430 is also configured to create a clean fillet.

Figure 5:
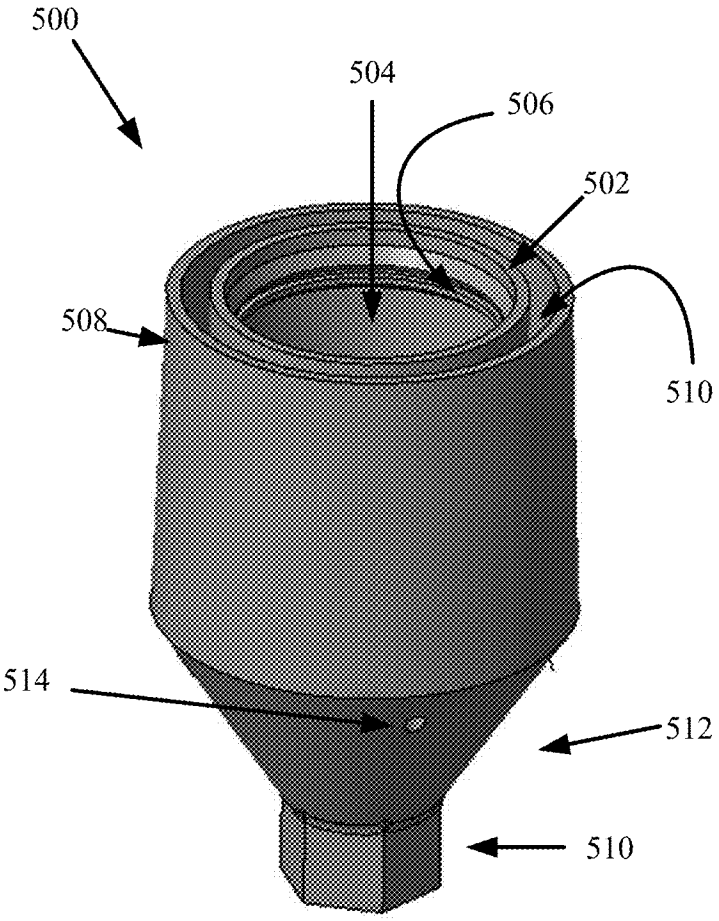
FIG. 5 provides a perspective view of a fitting.

FIG. 5 provides a perspective view of a cup member 500 for an end fitting. Cup member 402 of FIG. 4 may be the same or similar to cup member 500. As such, the discussion of cup member 500 is sufficient for understanding cup member 406.

Cup member 500 comprises an inner sidewall 502 defining an internal open area 504. An optional retention feature 506 is provided on or in the inner sidewall 502 to facilitate a coupling of a spring retention member and/or a sealing member to the cup member 500. The spring retention member will be discussed below in relation to FIG. 7. Inner sidewall 502 comprises a tapered adherend. An outer sidewall 508 is also provided. Outer sidewall 508 also comprises a tapered adherend. Sidewalls 502, 508 define an insert space 510 therebetween which is sized and shaped for receiving a strut or tube. An optional hex shaped structure 510 may be provided at an end 512 of the cup member 500 for facilitating movement or actuation of the cup member about a threaded flexure member (not shown in FIG. 5). One or more injection holes 514 are provided to facilitate injection of a bonding agent into the insert space 510 for coupling a strut or tube to the cup member 500.

Figure 6:
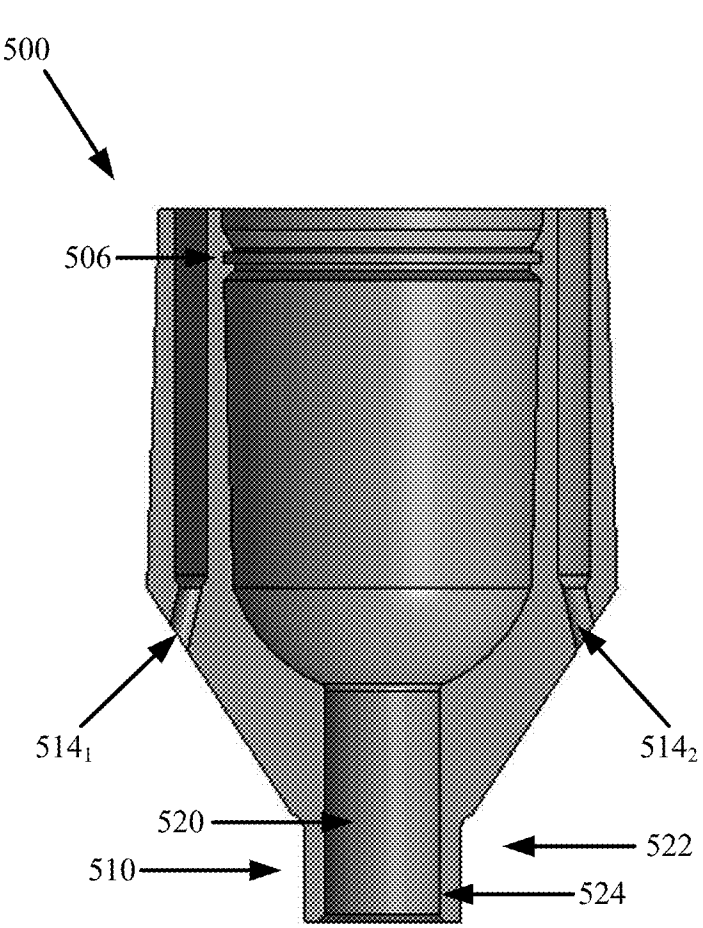
FIG. 6 provides a cross-sectional view of the fitting shown in FIG. 5.

A cross-sectional view of the cup member 500 is provided in FIG. 6. As seen in FIG. 6, at least two injection holes $\mathbf{514}_1$, $\mathbf{514}_2$ are provided. Injection holes $\mathbf{514}_1$, $\mathbf{514}_2$ are spaced 180° from each other. The present solution is not limited in this regard. Any number of injection holes may be provided with any spacing therebetween.

Cup member 500 has an aperture 520 formed in an end 522 thereof. Aperture 520 is sized and shaped to receive a flexure member (e.g., flexure member 404 of FIG. 4). Threads (not shown) or other features may be provided on an inner sidewall 524 defining aperture 520 for engaging with the flexure member to facilitate end fitting length adjustments.

Figure 7:
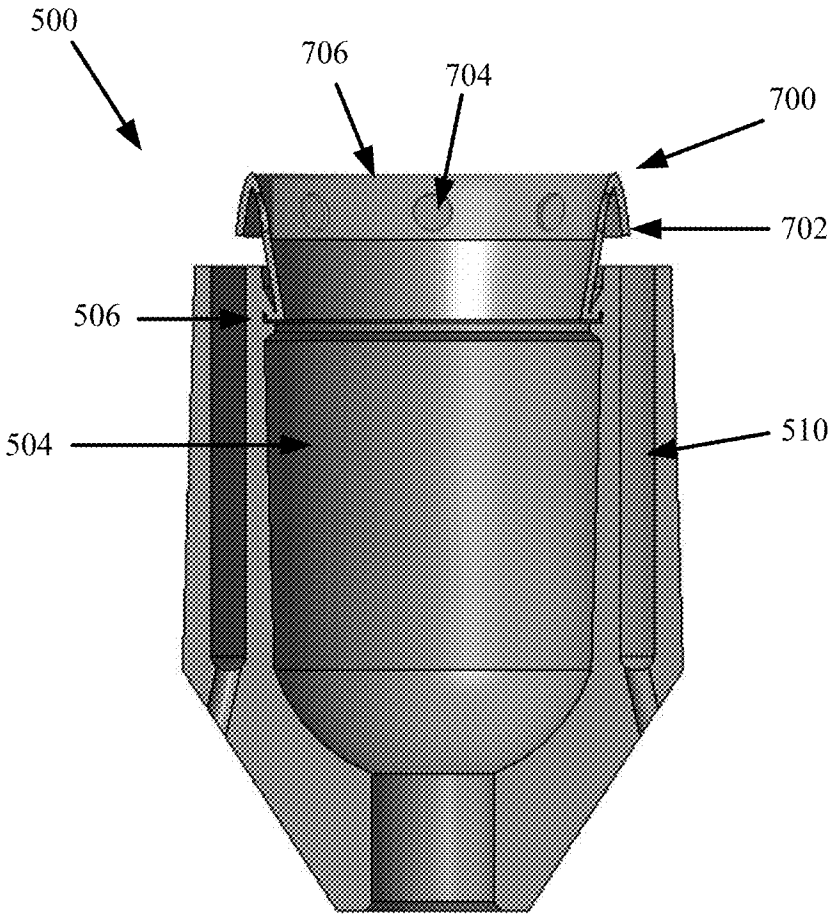
FIG. 7 provides a cross-sectional view of the fitting shown in FIG. 5 with a resilient element coupled thereto.

FIG. 7 also provides an illustration showing a spring retention member 700 coupled to the cup member 500 via retention feature 506. Spring retention member 700 may include, but is not limited to, a conductive material to provide a dissipative ground path between a strut/tube and the cup member 500. For example, spring retention member 700 may be formed of stainless steel. The present solution is not limited in this regard. Spring retention member 700 extends the entire circumference of the cup member 500 and is configured to engage the strut or tube. In this regard, it should be noted that an engagement portion 702 of the spring retention member 700 contacts and applies an outward radial force or pressure on the strut or tube when the strut/tub is inserted into insert space 510.

Engagement portion 702 has one or more holes 704 formed therein to allow air to vent into open area 504 of cup member 500 and/or into the strut/tube during an injection bonding process. A sealing member 706 is coupled to the engagement portion 702 so as to cover the holes 704. In this way, the sealing member 706 has multiple functions: (i) to allow air to escape but not the bonding agent during the injection bonding process; and (ii) to facilitate creation of a seal between the strut/tube and the end fitting.

FIG. 8 provides illustrations that are useful for understanding how a strut or tube is coupled between two nodes 800, 802 using adjustable end fittings 804, 806 of the present solution. In a first step of FIG. 8A, the end fittings 804, 806 are actuated to increase the distance 840 therebetween. For example, each end fitting is rotated to convert rotational movement to linear movement in a direction toward a respective node. The present solution is not limited in this regard. Other techniques may be employed to change distance 840.

Figure 8A:
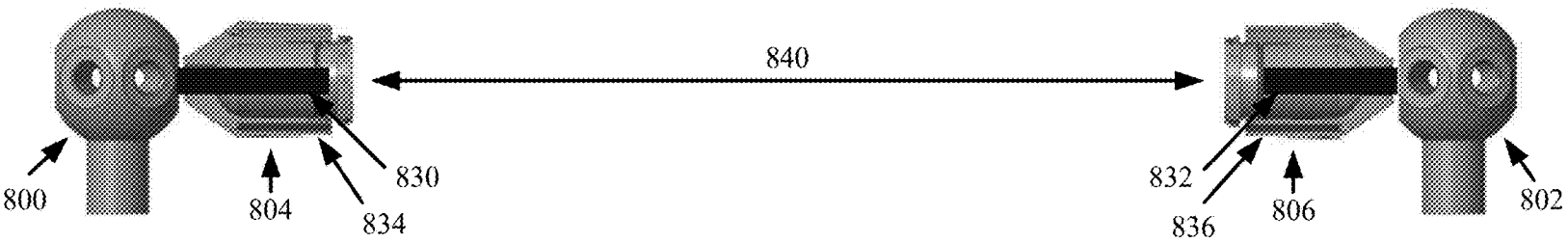
FIGS. 8A-8E (collectively referred to as "FIG. 8") provide illustrations showing a process for coupling a tube to a node using adjustable fittings.
Figure 8B:
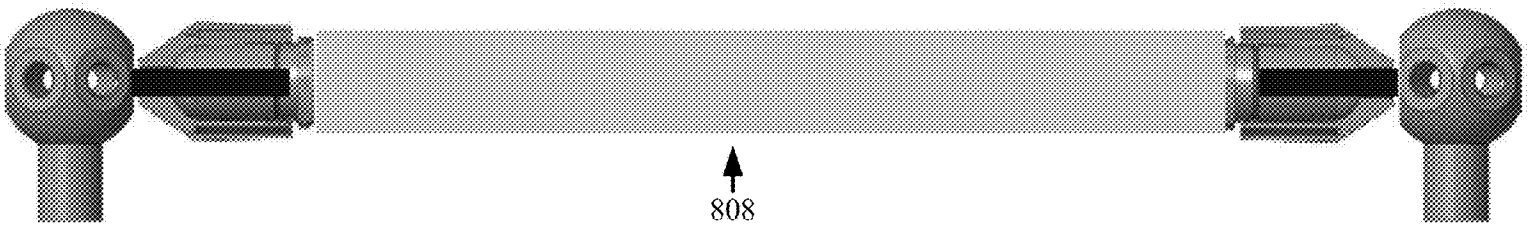
Figure 8C:
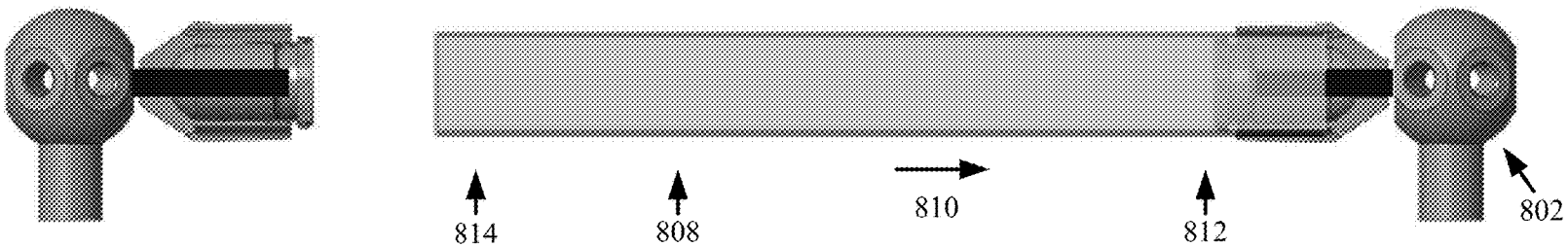
Figure 8D:
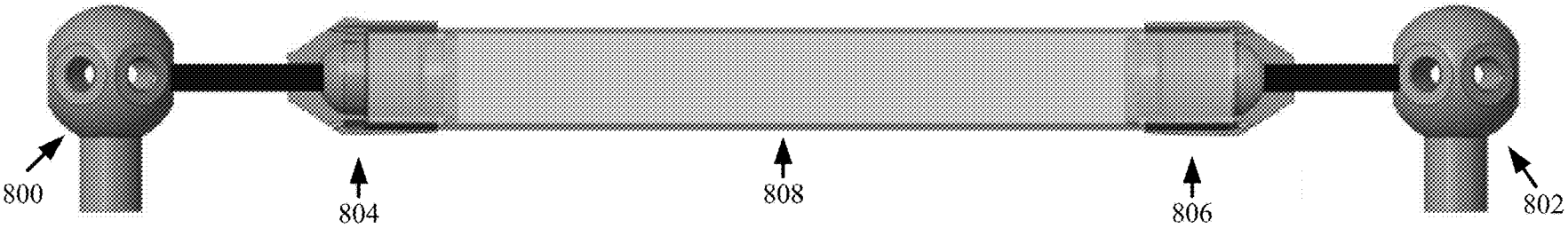

Next in FIG. 8B, a tube 808 is inserted in between end fittings 804, 806. Tube 808 is then slid in a direction toward one of the nodes. For example, as shown in FIG. 8C, tube 808 is slid or otherwise moved in direction 810 towards node 802 until its end 812 is fully inserted into an insert space of end fitting 806. The present solution is not limited in this regard. Tube 808 could alternatively be slid or otherwise moved in an opposing direction until its end 814 is fully inserted into an insert space of end fitting 804. As shown in FIG. 8D, the end fitting 804, 806 are actuated to decrease the distance 840 therebetween. In this way, tube 808 is coupled to and retained in between nodes 800, 802 via end fittings 804, 806.

Figure 8E:
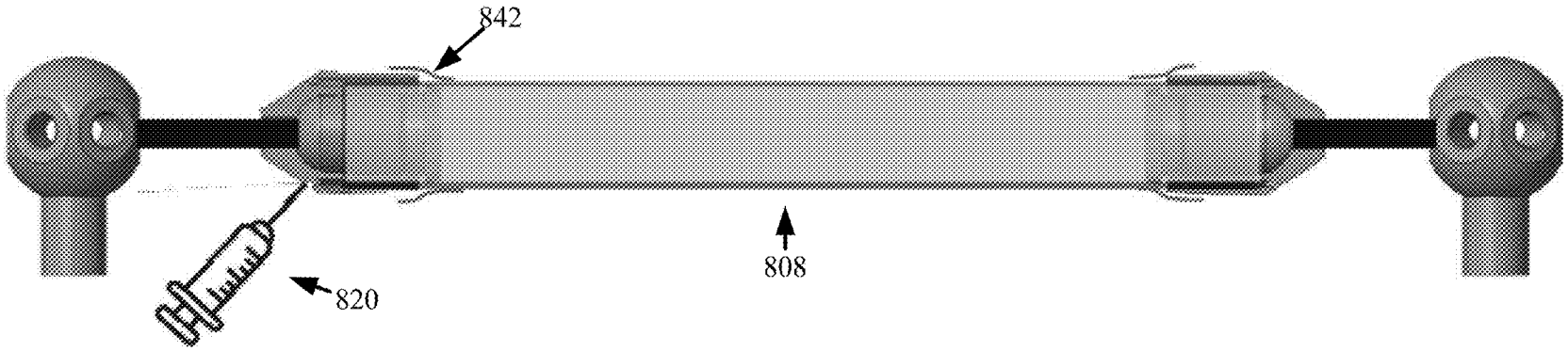

Next in FIG. 8E, the outer seal 842 is installed. An injection bonding process is performed to bond tube 808 to end fitting 804, 806. An injection tool 820 may be employed to facilitate injection of the bonding agent into the insert spaces of the end fitting 804, 806. Any known or to be known injection bonding process can be used here.

Figure 9B:
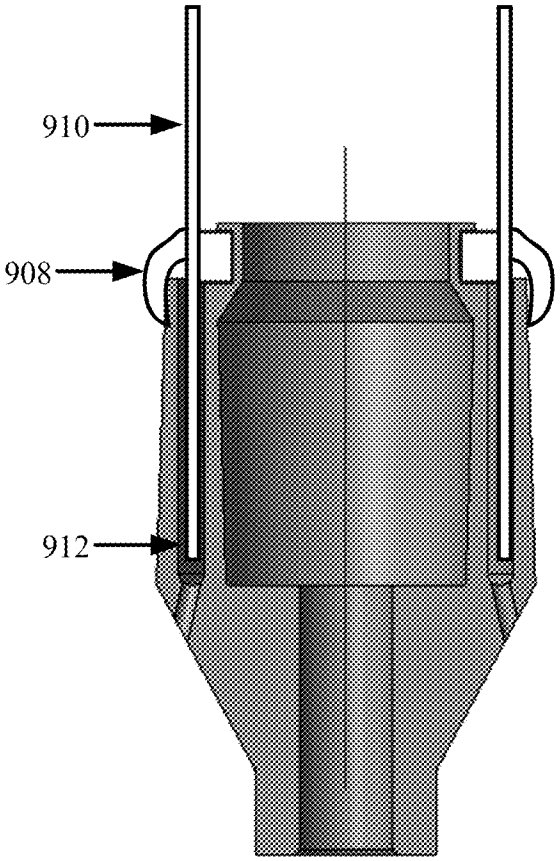
FIGS. 9A-9B (collectively referred to as "FIG. 9") provide illustrations that is useful for understanding how a novel seal is provided at each interconnection point between a tube and a fitting.
Figure 9A:
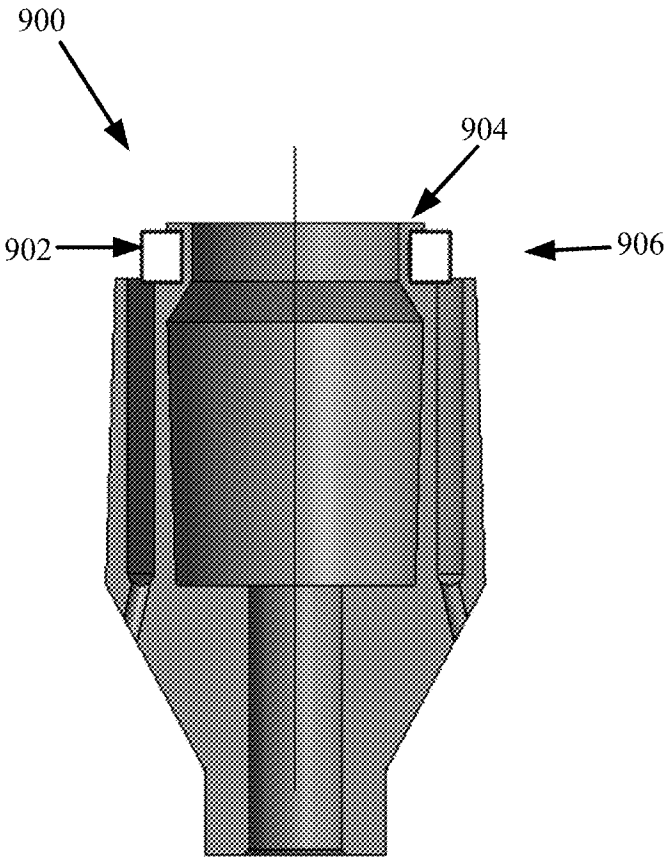
Figure 10:
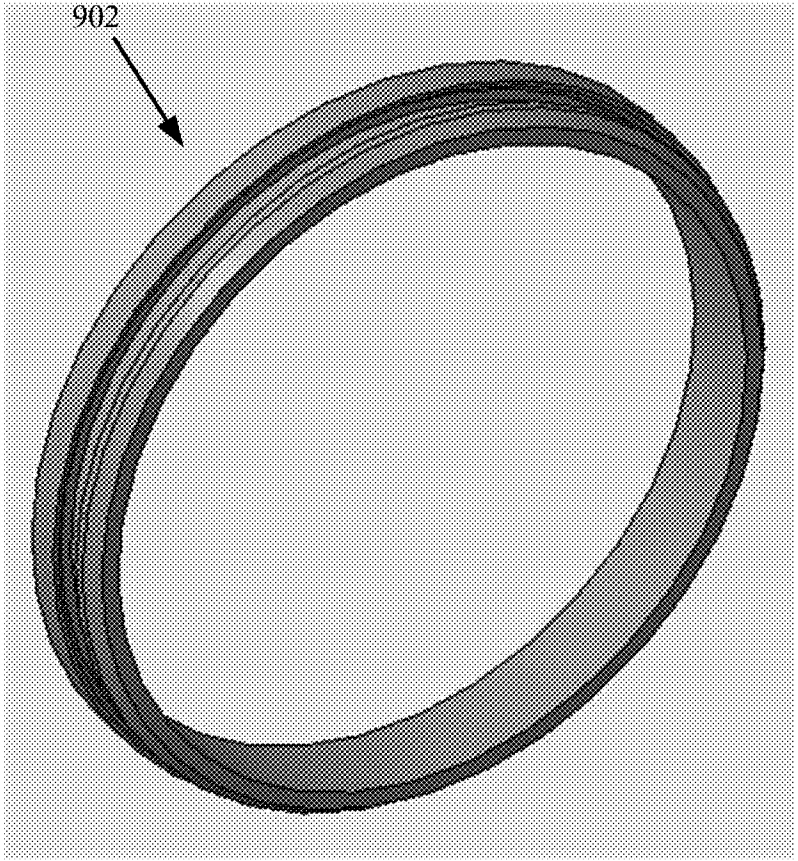
FIG. 10 provides a perspective view of the sealing member shown in FIG. 9A.

FIG. 9 provides cross-sectional view of another cup member 900 implementing the present solution. Cup member 900 comprises an annular sealing member 902 disposed around a flange 904 provided at end 906 thereof. A perspective view of the annular sealing member 902 is provided in FIG. 10. Another annular sealing member 908 is attached to the assembly after a tube 910 has been inserted into insert space 912. Sealing member 908 is shown as comprising a tape wrapped around end 906 of the cup member 900. The present solution is not limited in this regard. Sealing member 908 may comprise a band-like structure that is the same as or similar to that of sealing member 902 shown in FIG. 10.

The present solution can be used in other applications than that discussed above. For example, the present solution can be used in angled bracket mounting applications. One such application is shown in FIG. 11.

Figure 11:
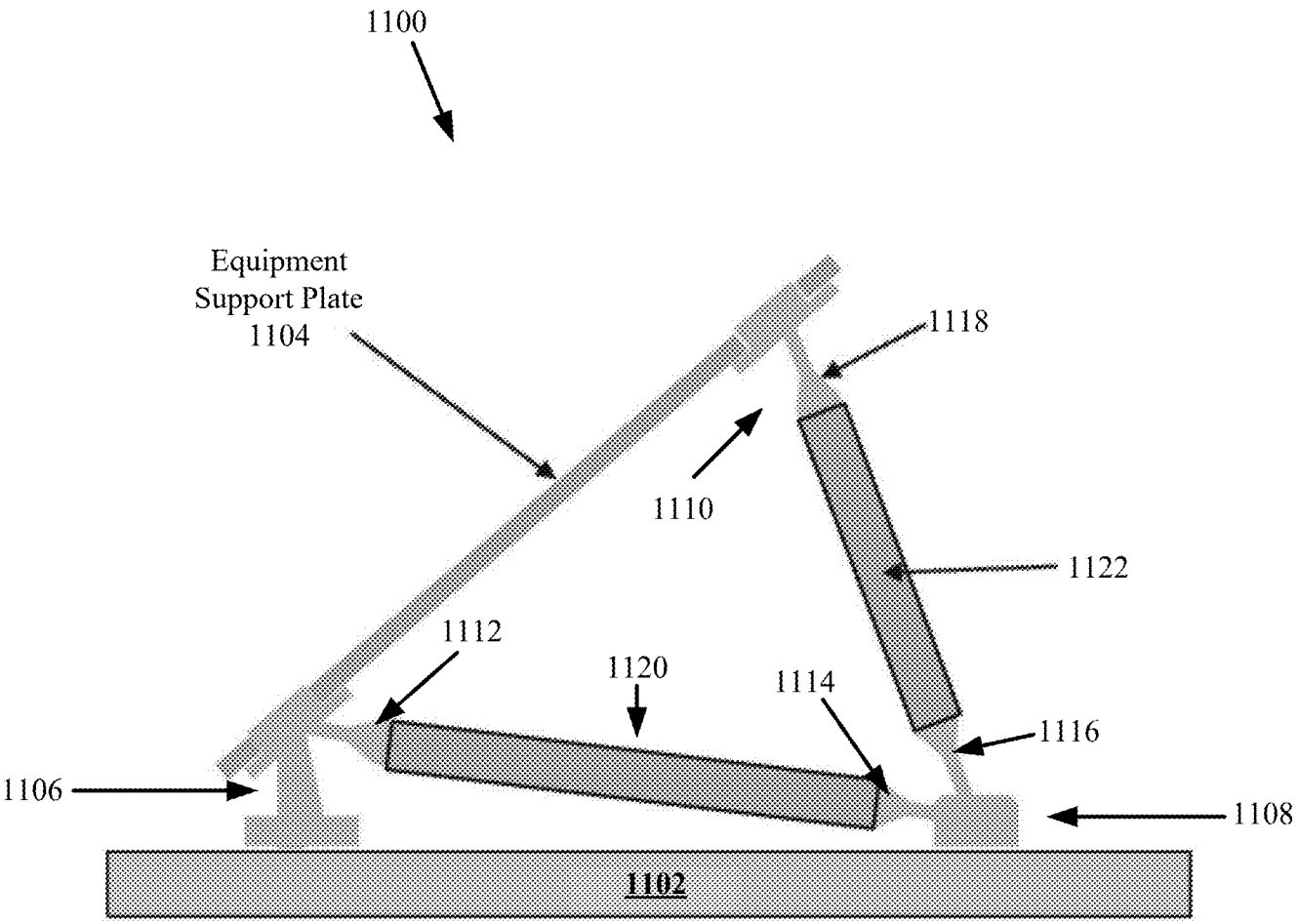
FIG. 11 provides an illustration showing another system implementing the present solution.

FIG. 11 provides an illustration of a truss structure 1100 implementing the present solution. Truss structure 1100 may be used to mount equipment on angled brackets 1106, 1108, 1110. The angled bracket design on conventional truss structures causes about forty percent of the thermal distortion pointing error. The angled brackets 1106, 1108, 1110 of the present solution are designed to reduce, minimize or eliminate any thermal distortion pointing error caused thereby. Brackets 1106, 1108, 1110 can include end fittings 1112, 1114, 1116, 1118 that are the same as or similar to end fitting(s) 118 of FIG. 1, 220-234 of FIG. 2, 330 of FIG. 3, 400 of FIG. 4, and/or 804-806 of FIG. 8. Accordingly, fittings 1112-1118 are configured to allow installation of struts or tubes 1120, 1122 in the assembly being built on base structure 1102.

Plate 1104 may be coupled to brackets 1106, 1110 for structurally supporting equipment. Plate 1104 may optionally have a triangular shape with a center cut-out. Struts or tubes 1120, 1122 share a common vertex at center of equipment interface and center of base structure interface. A flexure length may be sized so that the overall strut CTE approaches zero.

In view of the forgoing discussion, the present solution provides a structure system approach which will reduce mass of truss structures. For example, a truss structure of the present solution may have 55% less mass as compared to a corresponding conventional truss structure. The truss structures of the present solution also have a high thermal distortion stability. For example, a truss structure of the present solution may have reduced line-of-sight distortion by 40%. The nodes of the truss structures have a novel design that allows a high level of customization through 3D printing (i.e., any number of struts at any angle coming into any node). Adjustable end fittings allow for: assembly of a truss structure within tooled or constrained 3D system of struts; CTE tuning of each individual segment (different materials for node, flexure member, cup member, and/or tube) to create a near-zero CTE structure; and/or relief of moments in the truss structure using flexures. The porous seals allow for injection boding without trapping air in the end fittings. Trapping air in the end fittings could lead to voids and weaker/unpredictable strength. Flexible internal seal and generous bond cavity allows for take-up in part and assembly tolerances.

Figure 12:
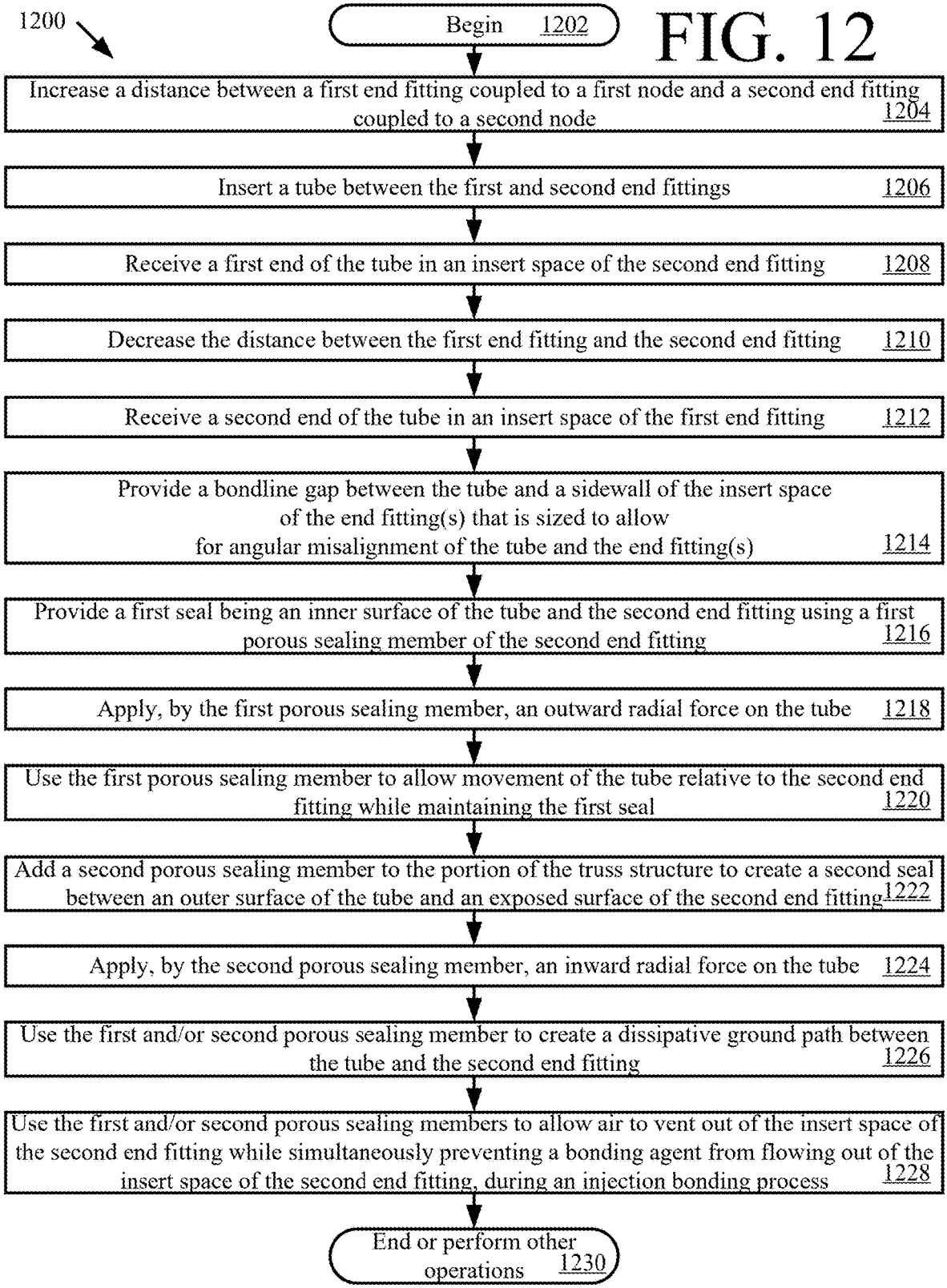
FIG. 12 provides a flow diagram of an illustrative method for providing a truss structure to structurally support equipment.

FIG. 12 provides a flow diagram of an illustrative method 1100 for providing a truss structure (e.g., truss structure 104 of FIG. 1, 200 of FIG. 2, 300 of FIG. 3, 400 of FIG. 4 and/or 1100 of FIG. 11) to structurally support equipment (e.g., equipment 108, 110 and/or 112 of FIG. 1). The operations of method 1200 may be performed in the same or different order than shown. Method 1200 may include more or less operations than shown. For example, CTE tuning operations may be performed between block 1202 and 1204. These CTE tuning operations may involve: tuning the CTE of the truss structure to have a near-zero value by using different materials for at least two of the first end fitting, the first node, and the tube; and/or tuning CTE of the truss structure to have a near-zero value by using different materials for the flexure member and a cup member of the first end fitting.

Figure 13:
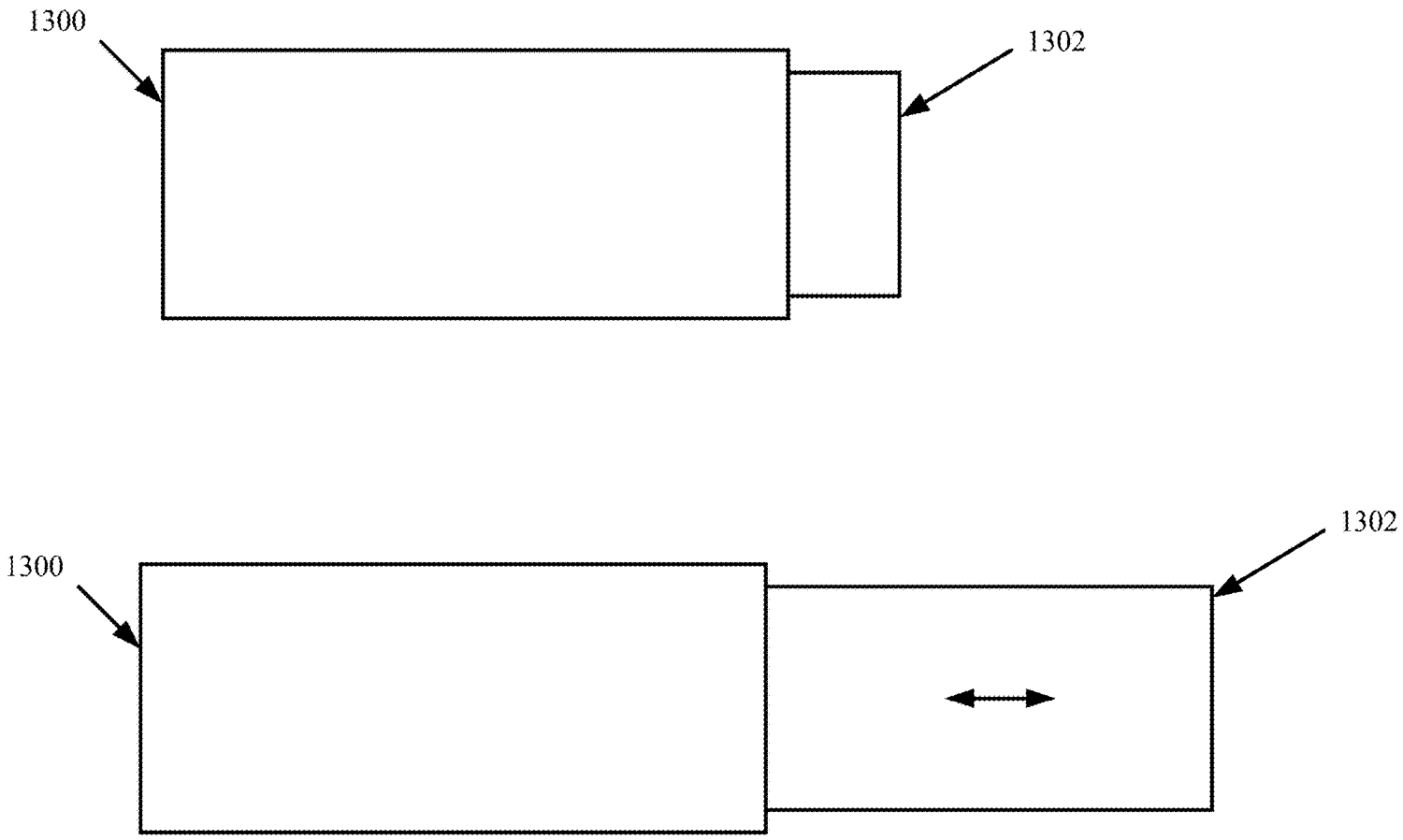
FIG. 13 provides an illustration of telescoping elements.

In the scenario of FIG. 12, method 1200 begins with block 1202 and continues to block 1204 where a distance (e.g., distance 840 of FIG. 8) is increased between a first end fitting (e.g., end fitting 230 of FIG. 2, 330 of FIG. 3, or 804 of FIG. 8) coupled to a first node (e.g., node 240 of FIG. 2, node 340 of FIG. 3, or 800 of FIG. 8) and a second end fitting (e.g., end fitting 228 of FIG. 2, 328 of FIG. 3, and/or 806 of FIG. 8) coupled to a second node (e.g., node 244 of FIG. 2, 344 of FIG. 3, and/or 802 of FIG. 2). This can be accomplished or achieved by actuating a flexure member (e.g., flexure member 250 of FIG. 2, 362 of FIG. 3, 404 of FIG. 4, and/or 830 of FIG. 8) to cause at least a cup member (e.g., cup member 402 of FIG. 4, 500 of FIG. 5, 834 of FIG. 8, and/or 900 of FIG. 9) of the first end fitting to move in a first direction (e.g., direction 350 of FIG. 3) toward the first node. The flexure member comprises a threaded rod (e.g., as shown in FIG. 4) or telescoping elements (e.g., telescoping element 1300, 1302 of FIG. 13). Block 1204 may also involve allowing an amount by which the flexure member extends into the cup member of the first end fitting to vary during said actuating thereof.

Next in block 1206, a tube (e.g., tube 210, 212, 214 of FIG. 2, 314 of FIG. 3, 420 of FIG. 4, 808 of FIG. 8, 910 of FIG. 9, 1120, and/or 1122 of FIG. 11) is inserted between the first and second end fittings. First end of the tube is received in an insert space (e.g., insert space 412 of FIG. 4 and/or 510 of FIG. 5) of the second end fitting, as shown by block 1208.

In block 1210, the distance between the first end fitting and the second end fitting is decreased. This can be accomplished by: actuating the flexure member to cause at least the cup member of the first end fitting to move in an opposing second direction (e.g., direction 352 of FIG. 3) away from the first node; and/or allowing an amount by which the flexure member extends into the cup member of the first end fitting to vary during said actuating. A second end of the tube is received in an insert space of the first end fitting as shown by block 1212.

Method 1200 may continue with operations of blocks 1214-1228. These operations involve: (1214) providing a bondline gap (e.g., bondline gap 424 of FIG. 4) between the tube and a sidewall of the insert space of the end fitting(s) that is sized to allow for angular misalignment of the tube and the end fitting(s); (1216) providing a first seal being an inner surface of the tube and the second end fitting using a first porous sealing member of the second end fitting; (1218) applying, by the first porous sealing member, an outward radial force on the tube to facilitate retention of the first end of the tube in the insert space of the second end fitting; (1220) using the first porous sealing member to allow movement of the tube relative to the second end fitting while maintaining the first seal; (1222) adding a second porous sealing member to the portion of the truss structure to create a second seal between an outer surface of the tube and an exposed surface of the second end fitting; (1224) applying, by the second porous sealing member, an inward radial force on the tube; (1226) using the first and/or second porous sealing member to create a dissipative ground path between the tube and the second end fitting; and/or (1228) using the first and/or second porous sealing members to allow air to vent out of the insert space of the second end fitting while simultaneously preventing a bonding agent from flowing out of the insert space of the second end fitting, during an injection bonding process. Subsequently, method 1200 continues to block 1230 where it ends or other operations are performed (e.g., return to 1202).

In view of the forgoing discussion, the present solution concerns implementing systems and methods for providing a truss structure to structurally support equipment, comprising: increasing a distance between a first end fitting coupled to a first node and a second end fitting coupled to a second node by actuating a flexure member to cause at least a cup member of the first end fitting to move in a first direction toward the first node; inserting a tube between the first and second end fittings; receiving a first end of the tube in an insert space of the second end fitting; decreasing the distance between the first end fitting and the second end fitting by actuating the flexure member to cause at least the cup member of the first end fitting to move in an opposing second direction away from the first node; and receiving a second end of the tube in an insert space of the first end fitting to provide a portion of the truss structure. The flexure member may include, but is not limited to, a threaded rod or telescoping elements.

The method may also comprise: allowing an amount by which the flexure member extends into the cup member of the first end fitting to vary during said actuating; providing a bondline gap between the tube and a sidewall of the insert space of the second end fitting that is sized to allow for angular misalignment of the tube and the second end fitting; providing a first seal being an inner surface of the tube and the second end fitting using a first porous sealing member of the second end fitting; applying, by the first porous sealing member, an outward radial force on the tube to facilitate retention of the first end of the tube in the insert space of the second end fitting; using the first porous sealing member to allow movement of the tube relative to the second end fitting while maintaining the first seal; using the first porous sealing member to allow air to vent out of the insert space of the second end fitting while simultaneously preventing a bonding agent from flowing out of the insert space of the second end fitting, during an injection bonding process; using the first porous sealing member to create a dissipative ground path between the tube and the second end fitting; adding a second porous sealing member to the portion of the truss structure to create a second seal between an outer surface of the tube and an exposed surface of the second end fitting; applying, by the second porous sealing member, an inward radial force on the tube; using the first and second porous sealing members to allow air to vent out of the insert space of the second end fitting while simultaneously preventing a bonding agent from flowing out of the insert space of the second end fitting, during an injection bonding process; and/or tuning a coefficient of thermal expansion of the truss structure to have a near-zero value by using different materials for at least two of the first end fitting, the first node, and the tube and or by using different materials for the flexure member and a cup member of the first end fitting.

The present solution also concerns a truss structure. A coefficient of thermal expansion of the truss structure may be tuned to have a near-zero value by using different materials for at least two of the first end fitting, the first node, and the tube and or by using different materials for the flexure member and a cup member of the first end fitting. The truss structure comprises: first and second nodes; a tube extending between the first and second nodes; a first end fitting coupling the first node to a first end of the tube; and a second end fitting coupling the second node to an opposing second end of the tube. The first end fitting comprises a cup member and a flexure member configured to be actuated to cause the cup member to move relative to the first node for changing a distance between a first end fitting and the second end fitting. The distance may be increased when the cup member is caused to move in a direction towards the first node, and decreased when the cup member is caused to move in a direction away from the first node. The flexure member can include, but is not limited to, a threaded rod or telescoping elements.

The first end fitting comprises an insert space sized and shaped to receive the first end of the tube, and second end fitting comprises an insert space sized and shaped to receive the second end of the tube. The first end fitting may be configured to (i) allow an amount by which the flexure member extends into the cup member to vary during an actuation of the flexure member. A bondline gap may be provided between the tube and a sidewall of an insert space of the first or second end fitting that is sized to allow for angular misalignment of the tube and the first or second end fitting.

The truss structure may also comprise a first porous sealing member configured to: (i) provide a first seal being an inner surface of the tube and the first or second end fitting; (ii) apply an outward radial force on the tube to facilitate retention of the first or second end of the tube in the insert space of the first or second end fitting; (iii) allow movement of the tube relative to the second or second end fitting while maintaining the first seal; (iv) allow air to vent out of the insert space of the first or second end fitting while simultaneously preventing a bonding agent from flowing out of the insert space of the first or second end fitting, during an injection bonding process; and/or (v) create a dissipative ground path between the tube and the second end fitting.

The truss structure may also comprise a second porous sealing member configured to (i) create a second seal between an outer surface of the tube and an exposed surface of the first or second end fitting; and/or (ii) allow air to vent out of the insert space of the first or second end fitting while simultaneously preventing a bonding agent from flowing out of the insert space of the first or second end fitting, during an injection bonding process.

The described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

I claim:

1. A truss structure, comprising:

first and second nodes;

a tube extending between the first and second nodes;

a first end fitting coupling the first node to a first end of the tube; and a second end fitting coupling the second node to an opposing second end of the tube;

wherein the first end fitting comprises a cup member and a flexure member configured to be actuated to cause the cup member to move relative to the first node for changing a distance between the first end fitting cup member and the second end fitting; and wherein the first end fitting comprises an insert space sized and shaped to receive the first end of the tube, and the second end fitting comprises an insert space sized and shaped to receive the second end of the tube.

2. The truss structure according to claim 1, wherein the distance is increased when the cup member is caused to move in a direction towards the first node, and decreased when the cup member is caused to move in a direction away from the first node.

3. The truss structure according to claim 1, wherein the flexure member comprises a threaded rod or telescoping elements.

4. The truss structure according to claim 1, wherein the first end fitting is configured to allow an amount by which the flexure member extends into the cup member to vary during an actuation of the flexure member.

5. A truss structure, comprising:

first and second nodes;

a tube extending between the first and second nodes;

a first end fitting coupling the first node to a first end of the tube; and a second end fitting coupling the second node to an opposing second end of the tube;

wherein the first end fitting comprises a cup member and a flexure member configured to be actuated to cause the cup member to move relative to the first node for changing a distance between a first end fitting and the second end fitting; and wherein a bondline gap is provided between the tube and a sidewall of an insert space of the first or second end fitting that is sized to allow for angular misalignment of the tube and the first or second end fitting.

6. A truss structure, comprising:

first and second nodes;

a tube extending between the first and second nodes;

a first end fitting coupling the first node to a first end of the tube;

a second end fitting coupling the second node to an opposing second end of the tube; and a first porous sealing member configured to provide a first seal being at an inner surface of the tube and the first or second end fitting;

wherein the first end fitting comprises a cup member and a flexure member configured to be actuated to cause the cup member to move relative to the first node for changing a distance between a first end fitting and the second end fitting.

7. The truss structure according to claim 6, wherein the first porous sealing member is configured to apply an outward radial force on the tube to facilitate retention of the first or second end of the tube in the insert space of the first or second end fitting.

8. The truss structure according to claim 6, wherein the first porous sealing member is further configured to allow movement of the tube relative to the second or second end fitting while maintaining the first seal.

9. The truss structure according to claim 6, wherein the first porous sealing member is further configured to allow air to vent out of the insert space of the first or second end fitting while simultaneously preventing a bonding agent from flowing out of the insert space of the first or second end fitting, during an injection bonding process.

10. The truss structure according to claim 6, wherein the first porous sealing member is further configured to create a dissipative ground path between the tube and the second end fitting.

11. The truss structure according to claim 6, further comprising a second porous sealing member configured to create a second seal between an outer surface of the tube and an exposed surface of the first or second end fitting.

12. The truss structure according to claim 11, wherein the second porous sealing member is configured to allow air to vent out of the insert space of the first or second end fitting while simultaneously preventing a bonding agent from flowing out of the insert space of the first or second end fitting, during an injection bonding process.

13. A truss structure, comprising:

first and second nodes;

a tube extending between the first and second nodes;

a first end fitting coupling the first node to a first end of the tube; and a second end fitting coupling the second node to an opposing second end of the tube;

wherein the first end fitting comprises a cup member and a flexure member configured to be actuated to cause the cup member to move relative to the first node for changing a distance between a first end fitting and the second end fitting; and wherein a coefficient of thermal expansion of the truss structure is tuned to have a near-zero value by using different materials for at least two of the first end fitting, the first node, and the tube and/or by using different materials for the flexure member and a cup member of the first end fitting.

* * * * *